US009459553B2

(12) United States Patent
Fujihara

(10) Patent No.: US 9,459,553 B2
(45) Date of Patent: Oct. 4, 2016

(54) IMAGE FORMING APPARATUS

(71) Applicant: KYOCERA Document Solutions Inc., Osaka (JP)

(72) Inventor: Kensuke Fujihara, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/815,347

(22) Filed: Jul. 31, 2015

(65) Prior Publication Data

US 2016/0033893 A1 Feb. 4, 2016

(30) Foreign Application Priority Data

Jul. 31, 2014 (JP) ..... 2014-156093

(51) Int. Cl.
*G03G 15/06* (2006.01)
*G03G 15/08* (2006.01)

(52) U.S. Cl.
CPC ..... *G03G 15/065* (2013.01); *G03G 15/0808* (2013.01)

(58) Field of Classification Search
CPC ..... G03G 15/0808; G03G 15/065; G03G 15/0886
USPC ..... 399/55, 53, 88, 89
See application file for complete search history.

(56) References Cited

U.S. PATENT DOCUMENTS 6,782,226 B2 8/2004 Machida et al.
2003/0175055 A1 9/2003 Machida et al.
2010/0254725 A1* 10/2010 Uetake ..... G03G 15/065 399/55

FOREIGN PATENT DOCUMENTS

JP 2003-287942 A 10/2003

* cited by examiner

*Primary Examiner* — Walter L Lindsay, Jr.
*Assistant Examiner* — Jessica L Eley
(74) *Attorney, Agent, or Firm* — Studebaker & Brackett PC

(57) ABSTRACT

An image forming apparatus includes a first roller, a second roller, a first voltage applying section, and a control section. An electrostatic latent image is formed on the first roller. The second roller is located opposite to the first roller with a first gap therebetween. The first voltage applying section applies voltage to the second roller. The control section determines a first voltage value to be applied to the second roller during development of the electrostatic latent image. The control section determines a first distance non-uniformity value indicating a degree of non-uniformity of a distance across the first gap. The control section determines a first indicator value by increasing voltage applied to the second roller in stages and performing electrical discharge measurement at each of the stages. The control section determines the first voltage value based on the first distance non-uniformity value and the first indicator value.

9 Claims, 6 Drawing Sheets

71

| 711 Current variation value (A) | 712 Distance non-uniformity value (μm) |
|---|---|
| x | 10 |
| y | 20 |
| z | 30 |
| ⋮ | ⋮ |

FIG. 4

72

| 721 Distance non-uniformity range (μm) | 722 Correction value (V) |
|---|---|
| At least 0 and less than 20 | 100 |
| At least 20 and less than 40 | 150 |
| ⋮ | ⋮ |

FIG. 5

IMAGE FORMING APPARATUS

INCORPORATION BY REFERENCE

The present application claims priority under 35 U.S.C. §119 to Japanese Patent Application No. 2014-156093, filed Jul. 31, 2014. The contents of this application are incorporated herein by reference in their entirety.

BACKGROUND

The present disclosure relates to image forming apparatuses.

In a commonly known image forming apparatus, a photosensitive drum and a development roller are located opposite to one another with a gap of a specific distance therebetween. The photosensitive drum is a cylindrical rotating member having a circumferential surface on which an electrostatic latent image is formed. The development roller is a cylindrical rotating member having a circumferential surface bearing developer, such as toner, for developing the electrostatic latent image formed on the photosensitive drum. In the image forming apparatus, a voltage of superposed direct current voltage and alternating current voltage is applied to the development roller causing charged toner to detach from the development roller to the photosensitive drum, and thereby developing the electrostatic latent image.

In the image forming apparatus, in order to improve development efficiency it is necessary to apply a sufficiently large voltage (referred to below as development bias) to the development roller in order that a sufficiently large amount of toner is supplied to the photosensitive drum. However, an excessively large development bias is problematic as explained below. That is, electric discharge may occur between the photosensitive drum and the development roller causing an artifact in the electrostatic latent image due to a change in electrical potential of the circumferential surface of the photosensitive drum. The artifact reduces quality of a resulting image formed on a sheet. Also, excessive current may flow in the photosensitive drum causing wearing of the photosensitive drum. Therefore, the development bias applied to the development roller during electrostatic latent image development is preferably as large as possible without being so large as to cause electric discharge to occur between the photosensitive drum and the development roller.

In one example, a developing device includes a leakage generating section and a leakage detecting section. In the aforementioned developing device, the leakage generating section causes leakage to occur between an image bearing member and a toner bearing member by adjusting voltage applied between the image bearing member and the toner bearing member. The leakage detecting section detects the leakage based on current flowing between the image bearing member and the toner bearing member.

SUMMARY

An image forming apparatus according to one aspect of the present disclosure includes a first roller, a second roller, a first voltage applying section, and a control section. An electrostatic latent image is formed on the first roller. The second roller is located opposite to the first roller with a first gap of a specific distance therebetween. The second roller bears developer thereon for developing the electrostatic latent image. The first voltage applying section applies voltage to the second roller. The control section determines a first voltage value to be used as a voltage value of voltage applied to the second roller during development of the electrostatic latent image. The control section determines a first distance non-uniformity value indicating a degree of non-uniformity of the distance across the first gap. The control section determines a first indicator value that is an indicator value for the first voltage value by increasing voltage applied to the second roller in stages and measuring at each of the stages whether or not electrical discharge occurs across the first gap. The control section determines the first voltage value based on the first distance non-uniformity value and the first indicator value.

BRIEF DESCRIPTION OF THE DRAWINGS

FIG. 4 illustrates configuration of an example of first correspondence management information according to an embodiment.

FIG. 5 illustrates configuration of an example of second correspondence management information according to an embodiment.

DETAILED DESCRIPTION

The following explains an embodiment of the present disclosure with reference to the drawings. Note that the embodiment explained below does not limit the disclosure according to the scope of the claims. Also, not all of the elements of configuration explained in the embodiment are essential for achieving the effects of the present disclosure. When the same reference sign is used in more than one of the drawings the reference sign indicates the same element of configuration in each drawing.

Figure 1:
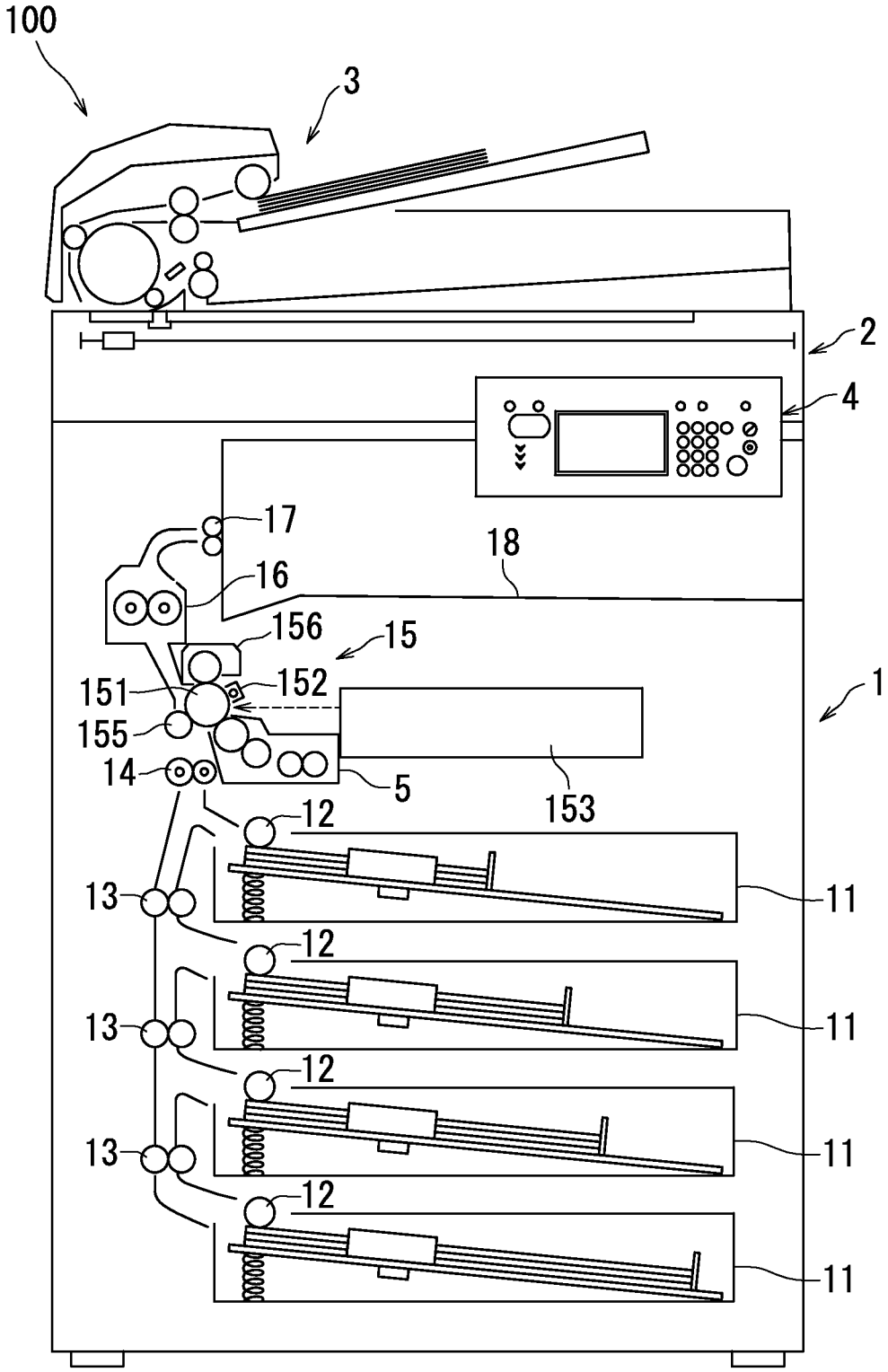
FIG. 1 illustrates configuration of an example of an image forming apparatus according to an embodiment.

FIG. 1 illustrates configuration of an example of an image forming apparatus according to the embodiment.

An image forming apparatus 100 is for example a multifunction peripheral (MFP). The image forming apparatus 100 has functions of a scanner, a copier, a printer, and a facsimile (fax) machine. The image forming apparatus 100 includes an image forming section 1 that forms an image on paper, an image reading section 2 that reads an image of a document, a document conveyance section 3 that conveys a document that is a reading target, and an operation section 4 through which a user operates the image forming apparatus 100.

The image forming section 1 includes paper feed cassettes 11, paper feed rollers 12, conveyance rollers 13, registration rollers 14, an image forming unit 15, a fixing unit 16, ejection rollers 17, and an exit tray 18. The paper feed rollers 12 pick up paper from the paper feed cassettes 11 one sheet at a time. Paper picked up by the paper feed rollers 12 is conveyed to the image forming unit 15 by the conveyance rollers 13 and the registration rollers 14.

The image forming unit 15 forms an image on paper conveyed from the paper feed cassettes 11. The image forming unit 15 includes a photosensitive drum 151, a charging device 152, a light exposure device 153, a developing device 5, a transfer roller 155, and a cleaning device 156. The photosensitive drum 151 (first roller) is a cylindrical rotating member. The photosensitive drum 151 has a circumferential surface on which an electrostatic latent image is formed. The charging device 152 charges the photosensitive drum 151 to a specific electrical potential. The light exposure device 153 forms an electrostatic latent image corresponding to image data on the photosensitive drum 151 by exposing the photosensitive drum 151 to laser light output from the light exposure device 153 based on the image data. The image data is for example image data generated through document reading by the image reading section 2 or image data received from an external computer via a communication network.

The developing device 5 forms a toner image on the photosensitive drum 151 by supplying developer (toner in the present embodiment) for developing the electrostatic latent image on the photosensitive drum 151. The developing device 5 is explained in detail further below with reference to FIG. 2. The transfer roller 155 transfers the toner image onto paper from the photosensitive drum 151. The cleaning device 156 removes residual toner remaining on the photosensitive drum 151 after transfer. The fixing unit 16 fixes the transferred toner image to the paper. The ejection rollers 17 eject the paper having the toner image fixed thereto onto the exit tray 18.

Figure 2:
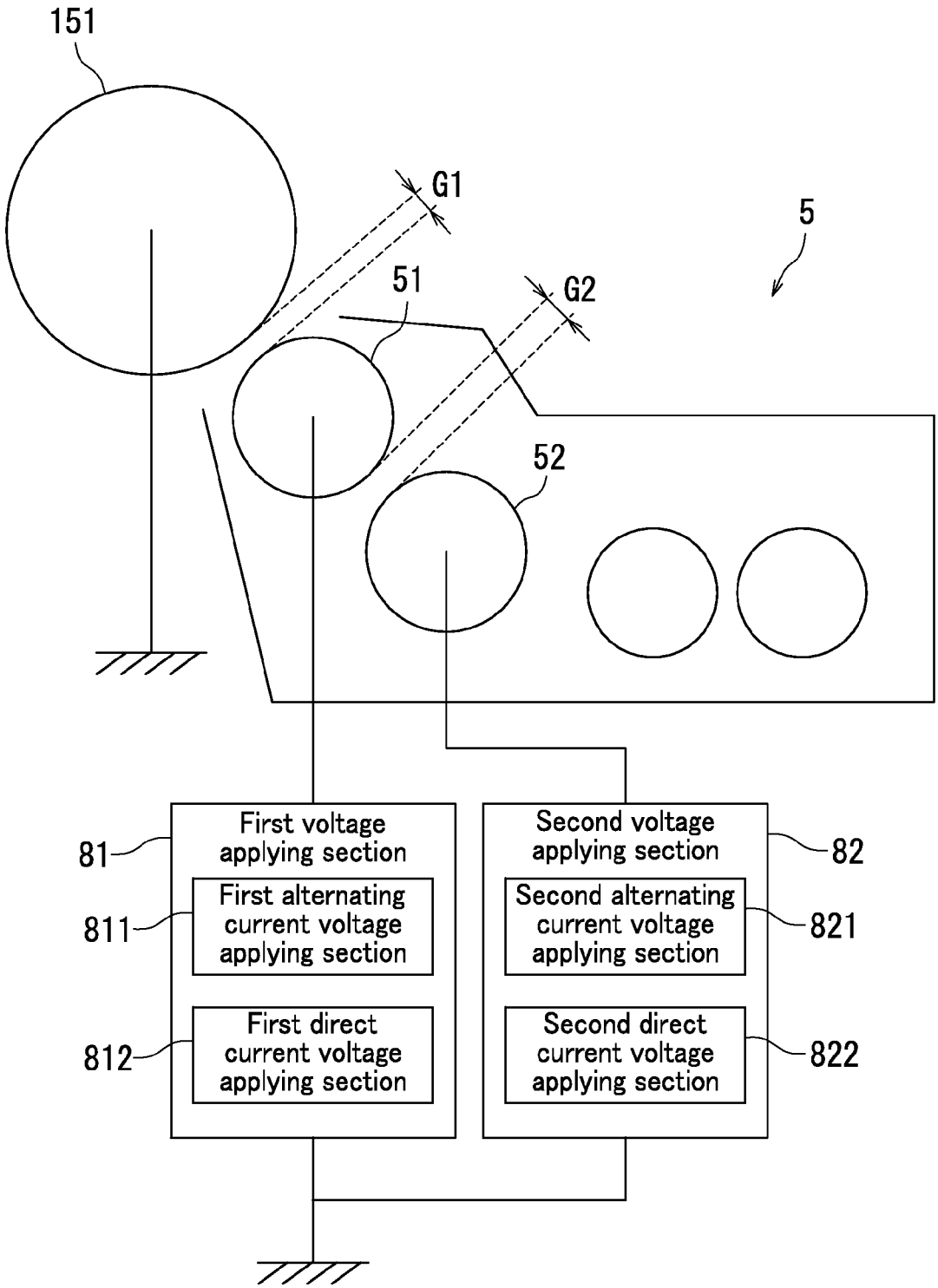
FIG. 2 illustrates configuration of an example of a developing device according to an embodiment.

FIG. 2 illustrates configuration of an example of the developing device according to the embodiment.

As illustrated in FIG. 2, the developing device 5 includes a development roller 51 and a toner supply roller 52. The development roller 51 (second roller) is a cylindrical rotating member. The development roller 51 is located opposite to the photosensitive drum 151 with a first gap G1 of a specific distance, for example 100 μm to 300 μm, therebetween. The development roller 51 has a circumferential surface bearing toner for developing an electrostatic latent image formed on the photosensitive drum 151.

The toner supply roller 52 (third roller) is a cylindrical rotating member. The toner supply roller 52 is located opposite to the development roller 51 with a second gap G2 of a specific distance, for example 300 μm, therebetween. The toner supply roller 52 supplies toner to the development roller 51.

The development roller 51 is electrically connected to a first voltage applying section 81. The first voltage applying section 81 applies a development bias of superimposed direct current and alternating current voltages under control of a control section 6 (refer to FIG. 3) explained further below. Application of the development bias to the development roller 51 causes charged toner to detach from the development roller 51 to the photosensitive drum 151, thereby developing an electrostatic latent image on the photosensitive drum 151.

The first voltage applying section 81 includes a first alternating current voltage applying section 811 and a first direct current voltage applying section 812. The first direct current voltage applying section 812 is a circuit for generating a direct current component of the development bias. Output of the first direct current voltage applying section 812 is input to the first alternating current voltage applying section 811. The first alternating current voltage applying section 811 is a circuit for generating the development bias based on the output of the first direct current voltage applying section 812. The development bias is for example a rectangle wave shaped (pulse shaped) voltage having an average value matching an output value of the first direct current voltage applying section 812. A voltage value of the development bias (for example, a potential difference between peaks and an average value) is determined by the control section 6.

The toner supply roller 52 is electrically connected to a second voltage applying section 82. The second voltage applying section 82 applies a toner supply bias of superimposed direct current and alternating current voltages to the toner supply roller 52 under control of the control section 6. Application of the toner supply bias to the toner supply roller 52 causes charged toner to detach from the toner supply roller 52 to the development roller 51, thereby supplying the toner to the development roller 51.

The second voltage applying section 82 includes a second alternating current voltage applying section 821 and a second direct current voltage applying section 822. The second direct current voltage applying section 822 is a circuit for generating a direct current component of the toner supply bias. An output of the second direct current voltage applying section 822 is input to the second alternating current voltage applying section 821. The second alternating current voltage applying section 821 is a circuit for generating the toner supply bias based on the output of the second direct current voltage applying section 822. The toner supply bias is for example a rectangle wave shaped (pulse shaped) voltage having an average value matching an output value of the second direct current voltage applying section 822. A voltage value of the toner supply bias (for example, a potential difference between peaks and an average value) is determined by the control section 6.

Figure 3:
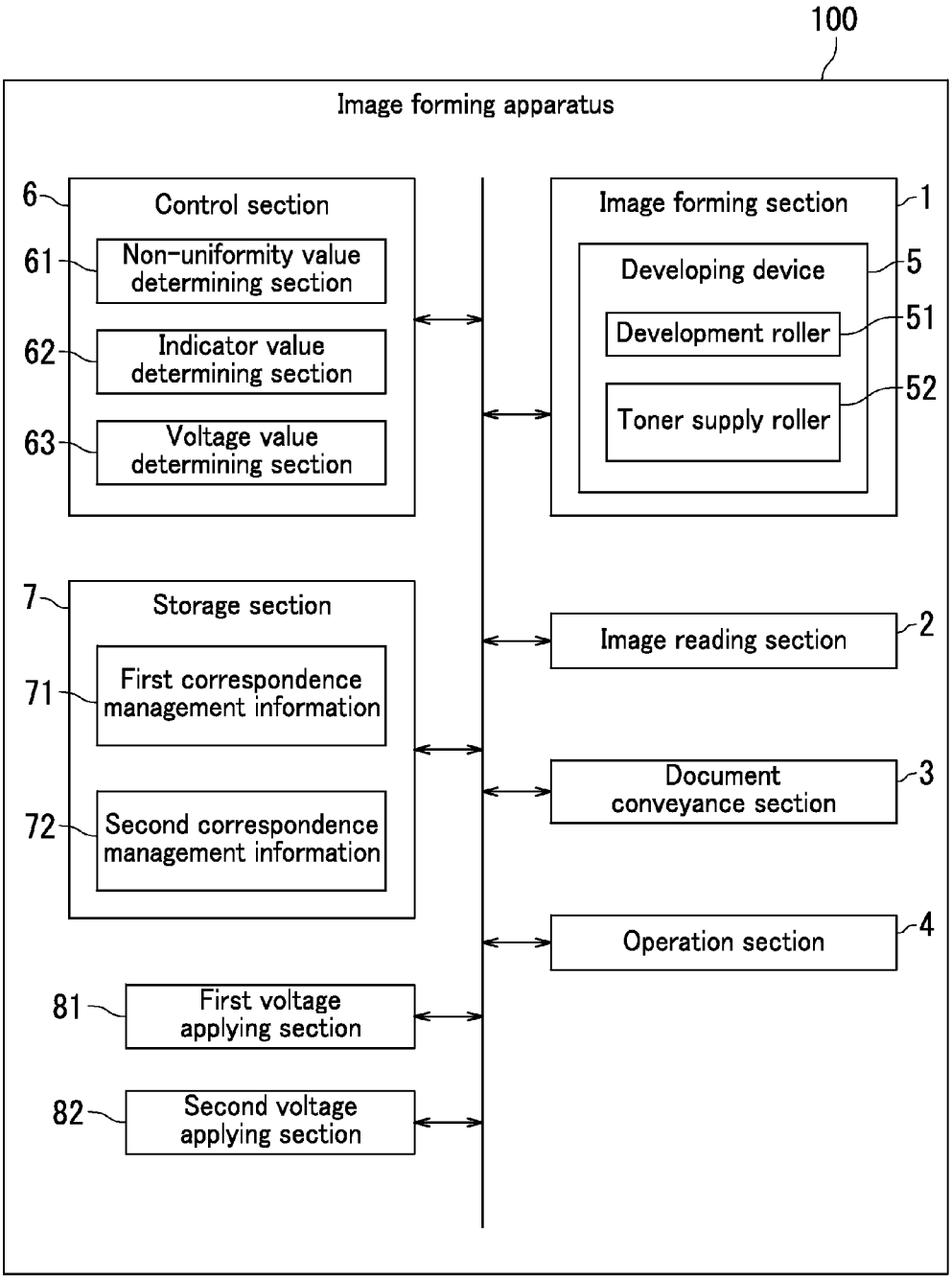
FIG. 3 is a block diagram of an example of an image forming apparatus according to an embodiment.

FIG. 3 is a block diagram of an example of the image forming apparatus according to the embodiment.

As illustrated in FIG. 3, the image forming apparatus 100 includes the control section 6 and a storage section 7 in addition to the image forming section 1, the image reading section 2, the document conveyance section 3, the operation section 4, the first voltage applying section 81, and the second voltage applying section 82. The image forming section 1, the image reading section 2, the document conveyance section 3, the operation section 4, the storage section 7, the first voltage applying section 81, and the second voltage applying section 82 are communicably connected to the control section 6.

The control section 6 is for example a central processing unit (CPU) that controls operation of the image forming apparatus 100. For example, the control section 6 controls the image forming section 1 to perform image formation. In addition, the control section 6 determines a voltage value (referred to below at a first voltage value) of the development bias applied to the development roller 51 during electrostatic latent image development. The control section 6 also determines a voltage value (referred to below as a second voltage value) of the toner supply bias applied to the toner supply roller 52 during supply of toner to the development roller 51. The control section 6 starts or suspends rotation of the photosensitive drum 151, the development roller 51, and the toner supply roller 52 at a desired timing, for example when causing the image forming section 1 to perform image formation or when performing measurements in order to determine the first voltage value and the second voltage value. The measurements for determining the first voltage value and the second voltage value more specifically involve measuring an amount of variation in current and measuring whether or not electric discharge occurs. The control section 6 includes a non-uniformity value determining section 61, an indicator value determining section 62, and a voltage value determining section 63.

The non-uniformity value determining section 61 determines a first distance non-uniformity value related to the first gap G1 based on an amount of variation in current (referred to below as a first current variation amount) that flows when the development bias is applied to the development roller 51 while the photosensitive drum 151 and the development roller 51 are rotating. The first distance non-uniformity value is a value (referred to below as a distance non-uniformity value) indicating the degree of non-uniformity in the distance across the first gap G1. The non-uniformity value determining section 61 for example suspends rotation of the toner supply roller 52 when measuring the first current variation amount. Also, the non-uniformity value determining section 61 determines a second distance non-uniformity value, which is a distance non-uniformity value relating to the second gap G2, based on an amount of variation in current (referred to below as a second current variation amount) that flows when the development bias is applied to the development roller 51 or the toner supply bias is applied to the toner supply roller 52 while the development roller 51 and the toner supply roller 52 are rotating. The non-uniformity value determining section 61 for example suspends rotation of the photosensitive drum 151 when measuring the second current variation amount.

The indicator value determining section 62 determines an indicator value (referred to below as a first indicator value) for the first voltage value by increasing the development bias applied to the development roller 51 in stages and measuring at each of the stages whether or not electric discharge occurs across the first gap G1. The indicator value determining section 62 for example determines the first indicator value to be a voltage value of the development bias applied to the development roller 51 at a first one of the stages at which electric discharge is detected to occur. In addition, the indicator value determining section 62 determines an indicator value (referred to below as a second indicator value) for the second voltage value by increasing the toner supply bias applied to the toner supply roller 52 in stages and measuring at each of the stages whether or not electric discharge occurs across the second gap G2. The indicator value determining section 62 for example determines the second indicator value to be a voltage value of the toner supply bias applied to the toner supply roller 52 at a first one of the stages at which electric discharge is detected to occur.

The voltage value determining section 63 determines the first voltage value based on the first distance non-uniformity value and the first indicator value. More specifically, the voltage value determining section 63 determines the first voltage value to be a value resulting from subtraction of a correction value corresponding to the first distance non-uniformity value from the first indicator value. In addition, the voltage value determining section 63 determines the second voltage value based on the second distance non-uniformity value and the second indicator value. More specifically, the voltage value determining section 63 determines the second voltage value to be a value resulting from subtraction of a correction value corresponding to the second distance non-uniformity value from the second indicator value.

The storage section 7 includes read only memory (ROM), random access memory (RAM), and a secondary storage device. The secondary storage device is for example a non-volatile storage device such as a hard disk or flash memory. The ROM of the storage section 7 stores various computer programs that are executed by the control section 6. The storage section 7 stores first correspondence management information 71 and second correspondence management information 72. The first correspondence management information 71 is information that manages a correspondence relationship between current variation amounts and distance non-uniformity values. The second correspondence management information 72 is information that manages a correspondence relationship between distance non-uniformity values and correction values. The first correspondence management information 71 and the second correspondence management information 72 are explained in detail further below with reference to FIGS. 4 and 5.

Functions of the control section 6 and functions of the non-uniformity value determining section 61, the indicator value determining section 62, and the voltage value determining section 63 are implemented through the control section 6 implementing the various computer programs that are loaded from the ROM to the RAM. Note that instead of implementing the functions of the non-uniformity value determining section 61, the indicator value determining section 62, and the voltage value determining section 63 through software, the aforementioned functions may be implemented through hardware provided in the image forming apparatus 100.

FIG. 4 illustrates configuration of an example of the first correspondence management information according to the embodiment.

The first correspondence management information 71 is information that manages a correspondence relationship between current variation amounts and distance non-uniformity values and is for example expressed in table format as illustrated in FIG. 4. The first correspondence management information 71 includes a data field for current variation values 711 and a data field for distance non-uniformity values 712. Values indicating amounts of variation in current (for example, in units of Amperes (A)) are stored as the current variation values 711. Distance non-uniformity values (for example, in units of μm) corresponding to the current variation amounts are stored as the distance non-uniformity values 712.

The non-uniformity value determining section 61 measures the first current variation amount and determines the first distance non-uniformity value based on the measured first current variation amount and the first correspondence management information 71. For example, when a measured value for the first current variation amount is x A, the non-uniformity value determining section 61 determines the first distance non-uniformity value to be a distance non-uniformity value that corresponds to x A in the first correspondence management information 71. In other words, the non-uniformity value determining section 61 determines the first distance non-uniformity value to be 10 μm. In addition, the non-uniformity value determining section 61 measures the second current variation amount and determines the second distance non-uniformity value based on the measured second current variation amount and the first correspondence management information 71. For example, when a measured value for the second current variation amount is y A, the non-uniformity value determining section 61 determines the second distance non-uniformity value to be a distance non-uniformity value that corresponds to y A in the first correspondence management information 71. In other words, the non-uniformity value determining section 61 determines the second distance non-uniformity value to be 20 μm.

It is not essential that the first correspondence management information 71 be represented in table format. For example, the first correspondence management information 71 may be information specifying a function that indicates a correspondence relationship between current variation amounts and distance non-uniformity values.

FIG. 5 illustrates configuration of an example of the second correspondence management information according to the embodiment.

The second correspondence management information 72 is information that manages a correspondence relationship between distance non-uniformity values and correction values. In the present embodiment, the second correspondence management information 72 manages a correspondence relationship between ranges of distance non-uniformity values and correction values corresponding to the aforementioned ranges, represented for example in table format as illustrated in FIG. 5. The second correspondence management information 72 includes a data field for distance non-uniformity ranges 721 and a data field for correction values 722. Data indicating ranges of distance non-uniformity values is stored as the distance non-uniformity ranges 721. Correction values (for example in units of Volts (V)) corresponding to the ranges of distance non-uniformity values are stored as the correction values 722.

The voltage value determining section 63 determines a correction value corresponding to the first distance non-uniformity value and a correction value corresponding to the second distance non-uniformity value based on the second correspondence management information 72. For example, when the first distance non-uniformity value is 10 μm, the first distance non-uniformity value is within a range of values of at least 0 μm and less than 20 μm. Therefore, the voltage value determining section 63 determines that the correction value corresponding to the first distance non-uniformity value is a correction value corresponding to the aforementioned range—in other words, 100 V. In another example, when the second distance non-uniformity value is 20 μm, the second distance non-uniformity value is within a range of values of at least 20 μm and less than 40 μm. Therefore, the voltage value determining section 63 determines that the correction value corresponding to the second distance non-uniformity value is a correction value corresponding to the aforementioned range—in other words, 150 V.

It is not essential that the second correspondence management information 72 is represented in table format. For example, the second correspondence management information 72 may be information specifying a function that indicates a correspondence relationship between distance non-uniformity values and correction values.

Figure 6:
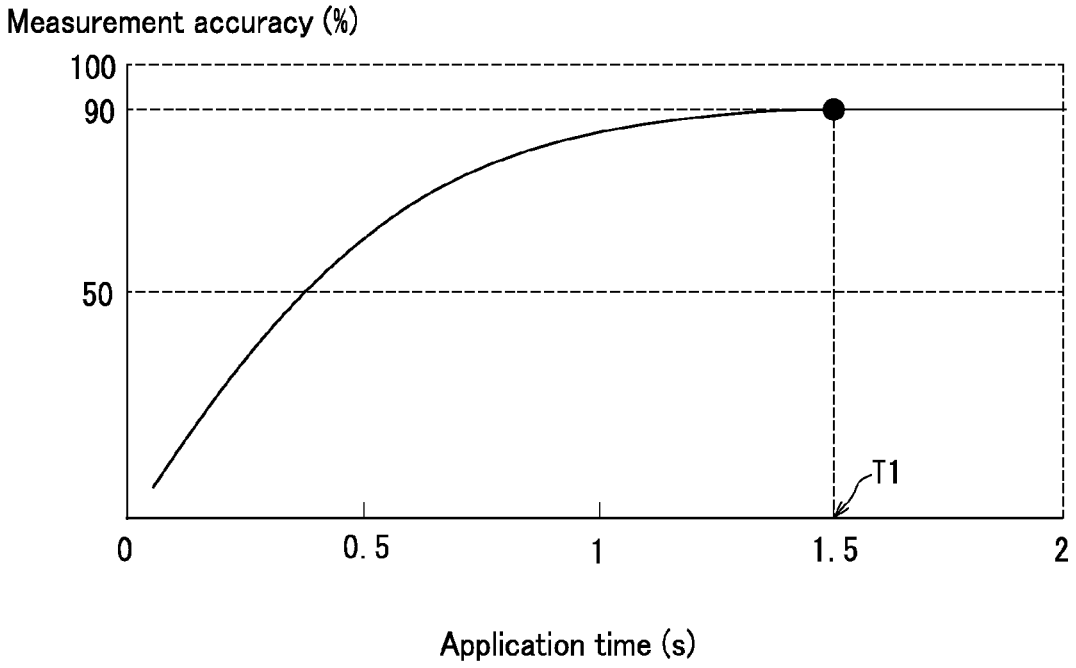
FIG. 6 illustrates a relationship between voltage application time during measurement of occurrence of electric discharge and accuracy of the measurement.

FIG. 6 illustrates a relationship between voltage application time during measurement of occurrence of electric discharge and accuracy of the measurement.

FIG. 6 illustrates a relationship between application time of the development bias or the toner supply bias when the indicator value determining section 62 measures whether or not electric discharge occurs in the first gap G1 or the second gap G2 (the aforementioned measurement is referred to below as electric discharge measurement) and accuracy of the measurement. As illustrated in FIG. 6, a value indicating accuracy of the electric discharge measurement increases with increasing length of time that the development bias or the toner supply bias is applied, but reaches a saturation level after a certain amount of time T1 (1.5 s in the example illustrated in FIG. 6). In the following description, the time T1 taken for the value indicating electric discharge measurement accuracy to reach the saturation level is referred to as a measurement accuracy saturation time.

As can be seen from FIG. 6, the indicator value determining section 62 can obtain more accurate measurement results during electric discharge measurement by continuing to apply the development bias or the toner supply bias for the measurement accuracy saturation time T1. However, if the measurement accuracy saturation time (i.e., 1.5 s) is required for each stage of electric discharge measurement, it will take a long time to determine a voltage value at which electric discharge starts (i.e., the first indicator value or the second indicator value in the present embodiment).

In consideration of the above, in the present embodiment the indicator value determining section 62 only applies the development bias to the development roller 51 for a specific application time T2 that is shorter than the measurement accuracy saturation time T1 when performing electric discharge measurement with respect to the first gap G1. In the same way, the indicator value determining section 62 only applies the toner supply bias to the toner supply roller 52 for a specific application time (in the present embodiment, the same as the application time T2 for electric discharge measurement of the first gap G1) that is shorter than the measurement accuracy saturation time T1 when performing electric discharge measurement with respect to the second gap G2. In the present embodiment, the application time T2 is for example 10 ms. Through the configuration described above, the time required for the indicator value determining section 62 to determine the first indicator value or the second indicator value is shortened.

On the other hand, shortening the application time of the development bias or the toner supply bias leads to a reduction in accuracy of electric discharge measurement. The following explains the meaning of the above statement. The indicator value determining section 62 determines the first indicator value to be a voltage value of the development bias that is applied to the development roller 51 at a stage at which electric discharge is first detected (referred to below as a detection stage). However, in reality the probability of electric discharge occurring even at a lower voltage value than the first indicator value increases with reduced measurement accuracy. The reasoning for the above is that if the application time of the development bias is shortened, there is a high probability that during stages of electric discharge measurement prior to the detection stage, electric discharge measurement may not be performed while the first gap G1 is in a narrowed state. In the same way, the indicator value determining section 62 determines the second indicator value to be a voltage value of the toner supply bias that is applied to the toner supply roller 52 at a stage at which electric discharge is first detected. However, in reality the probability of electric discharge occurring even at a lower voltage value than the second indicator value increases with reduced measurement accuracy.

In consideration of the above, in the present embodiment the voltage value determining section 63 determines the first voltage value or the second voltage value by correcting the first indicator value or the second indicator value in accordance with a distance non-uniformity value. More specifically, the voltage value determining section 63 determines the first voltage value to be a value that is lower than the first indicator value by a correction value corresponding to the first distance non-uniformity value. In the same way, the voltage value determining section 63 determines the second voltage value to be a value that is lower than the second indicator value by a correction value corresponding to the second distance non-uniformity value. As a result of performing correction such as described above, the finally determined first voltage value or second voltage value is an appropriate voltage value—that is, a voltage value that is as high as possible without leading to electric discharge.

The following explains a process that is performed by the image forming apparatus 100.

Figure 7:
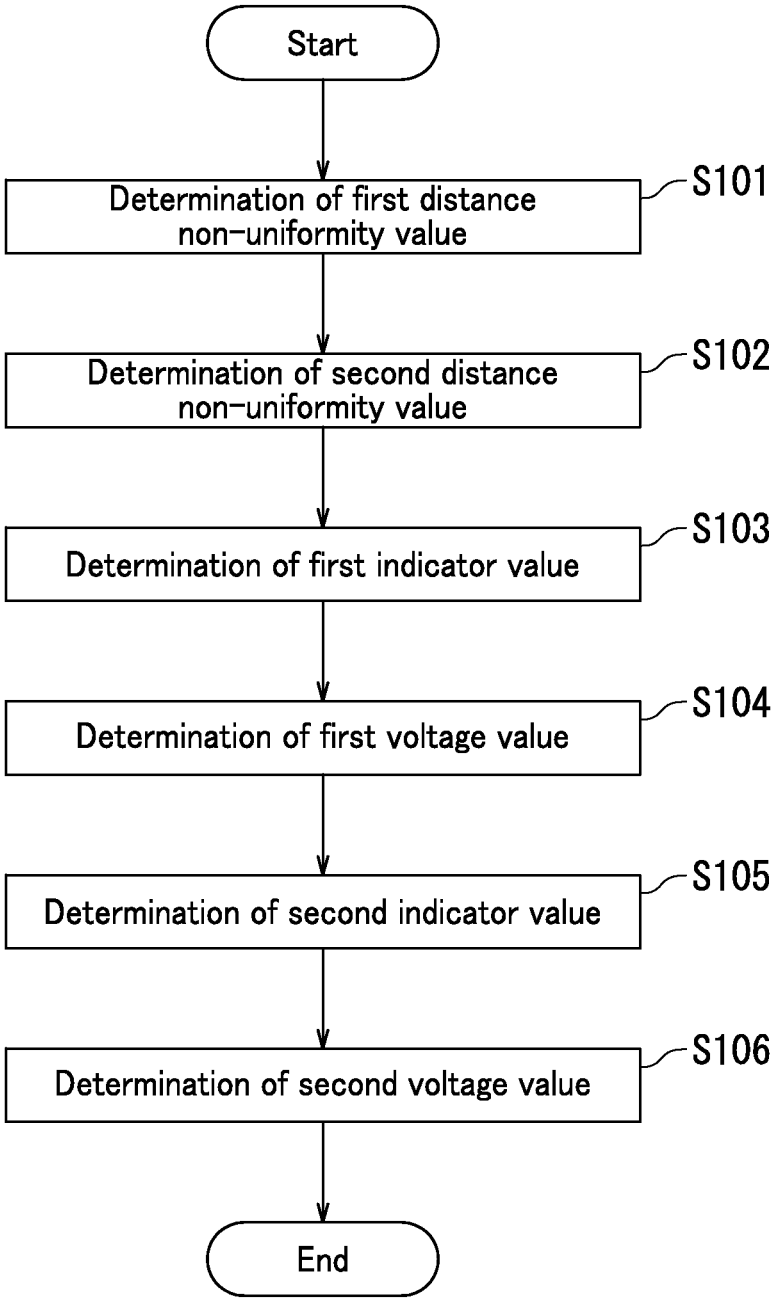
FIG. 7 is a flowchart of a process performed by a control section according to an embodiment.

FIG. 7 is a flowchart illustrating a process that is performed by the control section 6 according to the embodiment.

First, the non-uniformity value determining section 61 determines the first distance non-uniformity value based on the first current variation amount (Step S101).

More specifically, the non-uniformity value determining section 61 causes rotation of the photosensitive drum 151 and the development roller 51, and suspends rotation of the toner supply roller 52. The non-uniformity value determining section 61 then measures the first current variation amount by applying development bias of a specific voltage value to the development roller 51. After measuring the first current variation amount, the non-uniformity value determining section 61 determines the first distance non-uniformity value based on the measured first current variation amount and the first correspondence management information 71.

Next, the non-uniformity value determining section 61 determines the second distance non-uniformity value based on the second current variation amount (Step S102).

More specifically, the non-uniformity value determining section 61 suspends rotation of the photosensitive drum 151 and causes rotation of the development roller 51 and the toner supply roller 52. The non-uniformity value determining section 61 then measures the second current variation amount by applying development bias of a specific voltage value to the development roller 51 or by applying toner supply bias of a specific voltage value to the toner supply roller 52. After measuring the second current variation amount, the non-uniformity value determining section 61 determines the second distance non-uniformity value based on the measured second current variation amount and the first correspondence management information 71.

Next, the indicator value determining section 62 determines the first indicator value by increasing the development bias applied to the development roller 51 in stages and measuring at each of the stages whether or not electric discharge occurs across the first gap G1 (Step S103).

More specifically, first the indicator value determining section 62 causes rotation of the photosensitive drum 151 and the development roller 51. The indicator value determining section 62 then applies development bias of a specific initial voltage value to the development roller 51 for the application time T2 and measures whether or not electric discharge occurs across the first gap G1 during the application time T2. In a situation in which electric discharge does not occur, the indicator value determining section 62 sets a voltage value for the next stage as a voltage value resulting from addition of a specific step-up value ΔV to the initial voltage value. The indicator value determining section 62 then applies development bias of the voltage value for the next stage to the development roller 51 for the application time T2 and measures whether or not electric discharge occurs across the first gap G1 during the application time T2. The step-up value ΔV is for example 30 V to 100 V. The indicator value determining section 62 repeats an operation of increasing a voltage value of the development bias applied to the development roller 51 by the step-up value ΔV and performing electric discharge measurement until electric discharge is detected to occur. Once electric discharge is detected to occur, the indicator value determining section 62 determines the first indicator value to be a voltage value of the development bias applied to the development roller 51 when the electric discharge is detected to occur.

In the present embodiment, the application time T2 is shorter than the measurement accuracy saturation time T1 and is for example 10 ms. Therefore, the time required for electric discharge measurement at each of the stages is shortened and as a result the time required for determining the first indicator value is shortened.

Next, the voltage value determining section 63 determines the first voltage value based on the first distance non-uniformity value determined in Step S101 and the first indicator value determined in Step S103 (Step S104).

More specifically, first the voltage value determining section 63 determines a correction value corresponding to the first distance non-uniformity value based on the second correspondence management information 72. The voltage value determining section 63 then determines the first voltage value to be a value resulting from subtraction of the correction value corresponding to the first distance non-uniformity value from the first indicator value.

Next, the indicator value determining section 62 determines the second indicator value by increasing the toner supply bias applied to the toner supply roller 52 in stages and measuring at each of the stages whether or not electric discharge occurs across the second gap G2 (Step S105). While performing Step S105 of the process, the indicator value determining section 62 may for example cause development bias of the first voltage value determined in Step S104 to be applied to the development roller 51.

More specifically, first the indicator value determining section 62 causes rotation of the development roller 51 and the toner supply roller 52. The indicator value determining section 62 then applies toner supply bias of a specific initial voltage value to the toner supply roller 52 for the application time T2 and measures whether or not electric discharge occurs across the second gap G2 during the application time T2. In a situation in which electric discharge does not occur, the indicator value determining section 62 sets a voltage value for the next stage as a voltage value resulting from addition of a specific step-up value ΔV to the initial voltage value. The indicator value determining section 62 then applies toner supply bias of the voltage value for the next stage to the toner supply roller 52 for the application time T2 and measures whether or not electric discharge occurs across the second gap G2 during the application time T2. The step-up value ΔV is the same as in determination of the first indicator value and is for example 30 V to 100 V. The indicator value determining section 62 repeats an operation of increasing a voltage value of the toner supply bias applied to the toner supply roller 52 by the step-up value ΔV and performing electric discharge measurement until electric discharge is detected to occur. Once electric discharge is detected to occur, the indicator value determining section 62 determines the second indicator value to be a voltage value of the toner supply bias applied to the toner supply roller 52 when the electric discharge is detected to occur.

In the same way as in determination of the first indicator value, the application time T2 is shorter than the measurement accuracy saturation time T1 and is for example 10 ms. Therefore, the time required to perform electric discharge measurement at each of the stages is shortened and as a result the time required to determine the second indicator value is shortened.

Next, the voltage value determining section 63 determines the second voltage value based on the second distance non-uniformity value determined in Step S102 and the second indicator value determined in Step S105 (Step S106).

More specifically, first the voltage value determining section 63 determines a correction value corresponding to the second distance non-uniformity value based on the second correspondence management information 72. The voltage value determining section 63 then determines the second voltage value to be a value resulting from subtraction of the correction value corresponding to the second distance non-uniformity value from the second indicator value. After the above, the control section 6 ends the process.

The process illustrated by the flowchart in FIG. 7 is for example performed at an installation time of the image forming apparatus 100 or a replacement time of the photosensitive drum 151 or the developing device 5. The reason for performing the process at the installation time of the image forming apparatus 100 is that the voltage value at which electric discharges starts changes in response a change in atmospheric pressure of an environment in which the image forming apparatus 100 is installed. The reason for performing the process at the replacement time of the photosensitive drum 151 or the developing device 5 is that the first gap G1 or the second gap G2 after replacement is different compared to before replacement. Note that the process illustrated by the flowchart in FIG. 7 may be performed in situations other than the installation time of the image forming apparatus 100 and the replacement time of the photosensitive drum 151 or the developing device 5.

According to the present embodiment, when performing electric discharge measurement at each of the stages during determination of the first indicator value or the second indicator value, the image forming apparatus 100 sets the application time of the development bias or the toner supply bias as the application time T2, which is shorter than the measurement accuracy saturation time T1. As a result, the time required for determining the first indicator value or the second indicator value is shortened. Therefore, the image forming apparatus 100 can determine an appropriate voltage value for the development bias during electrostatic latent image development (i.e., the first voltage value) in a shorter time. The image forming apparatus 100 can also determine an appropriate voltage value for the toner supply bias during toner supply to the development roller 51 (i.e., second voltage value) in a shorter time.

As a consequence of shortening the application time of the development bias or the toner supply bias, the accuracy of electric discharge measurement is reduced at each of the stages during determination of the first indicator value or the second indicator value. However, the image forming apparatus 100 according to the present embodiment determines the first voltage value by performing correction of the first indicator value that takes into account the non-uniformity of distance across the first gap G1. The image forming apparatus 100 also determines the second voltage value by performing correction of the second indicator value that takes into account the non-uniformity of distance across the second gap G2. As a result of performing correction such as described above, the finally determined first voltage value or second voltage value is an appropriate voltage value—in other words, a value that is as large as possible without leading to electric discharge.

The present disclosure provides the image forming apparatus 100 that efficiently determines a voltage value for voltage applied during electrostatic latent image development, for example, by the image forming apparatus 100 determining the voltage value in a shorter time.

Through the above description, an embodiment of the present disclosure has been explained. However, the present disclosure is not limited to the embodiment and various alterations may be made without deviating from the essence of the present disclosure.

For example, the order of steps of the process illustrated by the flowchart in FIG. 7 is not limited to the order illustrated in FIG. 7. For example, the control section 6 may perform the process of determining the second distance non-uniformity value in Step S102 after performing the process of determining the first voltage value in Step S104. Furthermore, the control section 6 may for example perform the process of determining the first indicator value in Step S103 prior to performing the process of determining the first distance non-uniformity value in Step S101. In the same way, the control section 6 may perform the process of determining the second indicator value in Step S105 prior to performing the process of determining the second distance non-uniformity value in Step S102.

Although the non-uniformity value determining section 61 determines the first distance non-uniformity value based on the first current variation amount in the present embodiment, the non-uniformity value determining section 61 may alternatively determine the first distance non-uniformity value as described in the following example. In the alternative example, the non-uniformity value determining section 61 measures a first rotation non-uniformity value indicating a degree of non-uniformity of rotation of the photosensitive drum 151 and a second rotation non-uniformity value indicating a degree of non-uniformity of rotation of the development roller 51, and determines the first distance non-uniformity value based on the first rotation non-uniformity value and the second rotation non-uniformity value. The first rotation non-uniformity value is for example measured based on an amount of variation in current that flows when the development bias is applied to the development roller 51 while the photosensitive drum 151 is rotating. The second rotation non-uniformity value is for example measured based on an amount of variation in current that flows when the development bias is applied to the development roller 51 while the development roller 51 is rotating.

In the same way, although the non-uniformity value determining section 61 determines the second distance non-uniformity value based on the second current variation amount, the non-uniformity value determining section 61 may alternatively determine the second distance non-uniformity value as described in the following example. In the alternative example, the non-uniformity value determining section 61 measures the aforementioned second rotation non-uniformity value and a third rotation non-uniformity value indicating a degree of non-uniformity of rotation of the toner supply roller 52, and determines the second distance non-uniformity value based on the second rotation non-uniformity value and the third rotation non-uniformity value. The third rotation non-uniformity value is for example measured based on an amount of variation in current that flows when the toner supply bias is applied to the toner supply roller 52 while the toner supply roller 52 is rotating.

Furthermore, although explanation is provided for an example in which the image forming apparatus 100 is a multifunction peripheral, the image forming apparatus 100 is not limited to being a multifunction peripheral and may be any other apparatus that has an image formation function.

What is claimed is:

1. An image forming apparatus comprising:

a first roller on which an electrostatic latent image is formed;

a second roller located opposite to the first roller with a first gap of a specific distance therebetween and configured to bear developer thereon for developing the electrostatic latent image;

a first voltage applying section configured to apply voltage to the second roller; and a control section configured to determine a first voltage value to be used as a voltage value of voltage applied to the second roller during development of the electrostatic latent image, wherein the control section:

determines a first distance non-uniformity value indicating a degree of non-uniformity of the distance across the first gap, the non-uniformity of the distance across the first gap being accompanied by rotation of the first and second rollers;

determines a first indicator value to be a voltage value of voltage applied to the second roller at a first one of stages at which electric discharge is detected to occur by increasing voltage applied to the second roller in the stages and performing electric discharge measurement of measuring at each of the stages whether or not electric discharge occurs across the first gap, the first indicator value being an indicator value for the first voltage value; and determines the first voltage value to be a value resulting from subtraction of a correction value corresponding to the first distance non-uniformity value from the first indicator value, in the electric discharge measurement, the control section applies the voltage to the second roller for a specific application time in each of the stages, the specific application time is shorter than a measurement accuracy saturation time, and the measurement accuracy saturation time is a time taken for a value indicating accuracy of the electric discharge measurement to reach a saturation level.

2. The image forming apparatus according to claim 1, wherein the control section determines the first distance non-uniformity value based on an amount of variation in current that flows when voltage is applied to the second roller while the first roller and the second roller are rotating.

3. The image forming apparatus according to claim 1, wherein the larger the first distance non-uniformity value, the larger the correction value corresponding thereto.

4. The image forming apparatus according to claim 1, further comprising a storage section that stores management information therein for managing correspondence between the first distance non-uniformity value and the correction value, wherein the control section determines the first voltage value to be a value resulting from subtraction of the correction value corresponding to the first distance non-uniformity value in the management information from the first indicator value.

5. The image forming apparatus according to claim 1, further comprising:

a third roller located opposite to the second roller with a second gap of a specific distance therebetween and configured to supply the developer to the second roller; and a second voltage applying section configured to apply voltage to the third roller, wherein the control section:

determines a second voltage value to be used as a voltage value of voltage applied to the third roller during supply of the developer to the second roller;

determines a second distance non-uniformity value indicating a degree of non-uniformity of the distance across the second gap;

determines a second indicator value that is an indicator value for the second voltage value by increasing voltage applied to the third roller in stages and measuring at each of the stages whether or not electric discharge occurs across the second gap; and determines the second voltage value based on the second distance non-uniformity value and the second indicator value.

6. The image forming apparatus according to claim 5, wherein the control section:

determines the first distance non-uniformity value based on an amount of variation in current that flows when voltage is applied to the second roller while the first roller and the second roller are rotating, and the third roller is stationary; and determines the second distance non-uniformity value based on an amount of variation in current that flows when voltage is applied to the second roller or the third roller while the first roller is stationary, and the second roller and the third roller are rotating.

7. The image forming apparatus according to claim 1, wherein the specific application time has a time width in which there is a probability that the electric discharge measurement is not performed while the first gap is in a narrowed state.

8. The image forming apparatus according to claim 1, wherein the value indicating accuracy of the electric discharge measurement increases as a time for which voltage is applied to the second roller increases, and the value indicating accuracy of the electric discharge measurement reaches the saturation level when the measurement accuracy saturation time elapses.

9. The image forming apparatus according to claim 1, wherein the control section causes the first and second rollers to rotate, performs the electric discharge measurement for the specific application time by applying voltage at a specific initial voltage value to the second roller for the specific application time, sets, in a situation in which electric discharge does not occur, a voltage value for a next stage to be a voltage value resulting from addition of a specific step-up value to the specific initial voltage value, performs the electric discharge measurement for the specific application time by applying voltage at the voltage value for the next stage to the second roller for the specific application time, and repeating operation for the electric discharge measurement by increasing the voltage value of the voltage applied to the second roller by the specific step-up value until occurrence of electric discharge is detected.

* * * * *